US006771256B1

(12) United States Patent
Abraham et al.

(10) Patent No.: US 6,771,256 B1
(45) Date of Patent: Aug. 3, 2004

(54) REMOTELY PROGRAMMABLE CONTROL DEVICE FOR USE IN ELECTROLUMINESCENT DISPLAY AND LIGHTING APPLICATIONS

(75) Inventors: John M. Abraham, Princeton Junction, NJ (US); Bryan D. Haynes, Pacifica, CA (US); Matthew Wilkinson, Scotts Valley, CA (US); Mark Musal, Scotts Valley, CA (US)

(73) Assignee: iGraphics, LLC, Grass Valley, CA (US)

( * ) Notice: Subject to any disclaimer, the term of this patent is extended or adjusted under 35 U.S.C. 154(b) by 85 days.

(21) Appl. No.: 09/644,607

(22) Filed: Aug. 23, 2000

Related U.S. Application Data

(60) Provisional application No. 60/159,490, filed on Oct. 14, 1999.

(51) Int. Cl.[7] ..... G09G 5/00; G09G 3/30

(52) U.S. Cl. ..... 345/204; 345/76; 345/2.1

(58) Field of Search ..... 345/1.1, 2.1, 2.3, 345/45, 76, 204, 903; 315/169.33; 40/541, 542, 544

(56) References Cited

U.S. PATENT DOCUMENTS 5,257,020 A * 10/1993 Morse ..... 340/815.45
5,483,260 A * 1/1996 Parks et al. ..... 345/156
5,493,183 A * 2/1996 Kimball ..... 315/169.3
5,574,428 A * 11/1996 Groover ..... 340/468
5,629,714 A * 5/1997 Nishitani et al. ..... 345/2.3
5,652,606 A * 7/1997 Sasaki et al. ..... 345/204
5,652,845 A * 7/1997 Arai et al. ..... 710/106
5,870,110 A * 2/1999 Mallory ..... 345/903
5,905,434 A * 5/1999 Steffan et al. ..... 340/463
5,973,607 A * 10/1999 Munyon ..... 340/815.4
6,018,470 A * 1/2000 Vaananen et al. ..... 363/95
6,215,411 B1 * 4/2001 Gothard ..... 340/815.4
6,236,330 B1 * 5/2001 Cohen ..... 340/691.6
6,271,814 B1 * 8/2001 Kaoh ..... 340/815.45

FOREIGN PATENT DOCUMENTS

EP 0 665 525 A2 * 8/1995 ..... G09G/1/16

* cited by examiner

*Primary Examiner*—Steven Saras
*Assistant Examiner*—Paul A. Bell
(74) *Attorney, Agent, or Firm*—Warner Norcross & Judd LLP

(57) ABSTRACT

Described is a remotely programmable control device for use in electroluminescent display and lighting applications. Elements of this invention include a power supply, various inverters/wave form conditioners, a motherboard, inbound/outbound communications capability, motion-sensing devices, ambient light sensing facilities, and a floppy disk reader. Remote programmability is achieved through several methods including detecting the driving instructions from the lamp display itself, or downloading data from a remote network or a floppy disk.

12 Claims, 6 Drawing Sheets

REMOTELY PROGRAMMABLE CONTROL DEVICE FOR USE IN ELECTROLUMINESCENT DISPLAY AND LIGHTING APPLICATIONS

This application claims the benefit of U.S. Provisional Application No. 60/159,490, filed Oct. 14, 1999.

BACKGROUND OF THE INVENTION

1. Field of the Invention

The present invention relates to controllers for electroluminescent display and lighting systems. More particularly, the present invention relates to remotely programmable controllers for electroluminescent display and lighting systems.

2. Description of the Related Art

Electroluminescent display and lighting systems are presently known. A typical electroluminescent display system combines one or more electroluminescent lamps or other electroluminescent display elements with an electronic driver or controller. Often various graphical or artistic elements such as overlays are laminated onto the lamps. These systems can resemble circuits in that the display elements are segmented into various areas that are independently addressable. Power and wave form is delivered to the display elements by an electronic driver which also delivers display control through a series of electronic impulses that are sent through one or many channels that act as wiring for the circuit. These channels are mapped to the display element through a connection and subsequently, through preprinted traces that address each independent area of the display.

Existing electroluminescent lamp controllers contain a microprocessor that contains pre-programmed instructions that control the sequence of impulses that are sent from the controller to the display element, thereby allowing the electroluminescent system to serve a single, useful purpose. These microprocessors are resident in the controllers, and have been pre-programmed at a factory or distributor. The instructions that comprise the program are therefore fixed, having in essence been previously hard-wired by humans at an industrial site that is often distant from the place where the electroluminescent system is intended to be deployed. The microprocessor is the heart of the controller, and since it is very difficult to easily modify this electronic part, the controller is therefore relegated to a single purpose or a one-time use.

There are several known problems with controllers that use the architecture described above. First, since it is difficult to modify these devices, they tend to be dedicated to a single display device. Reworking these controllers requires shipment to an industrial facility, wherein the microprocessors must be physically replaced or reprogrammed when possible or discarded. This process requires time and effort, and carries a significant cost to replace the microprocessor. Since it is very difficult to know in advance the object (or program) for each display element that will be manufactured in the future, it is difficult to build an inventory of electronic devices that can rapidly satisfy customers' differing demands for the various display systems. Accordingly, the costs for these electroluminescent systems are higher than they would be if a more flexible, reusable electronic controller were in use. Because there is much shipment and other physical movement of existing controllers, breakage and loss is relatively high.

SUMMARY OF THE INVENTION

The invention described herein remedies many known controller problems by substituting a remotely programmable computer in place of the microprocessor. This computer, called the motherboard, allows the controller to generically control any electroluminescent display system, and it permits the controller to be immediately reusable, without movement, for any subsequent display. The motherboard is remotely programmable either by a series of instructions carried within the display system itself, or by instructions that are downloaded into the controller from a wireless device and/or a telephonic connection.

The invention uses elements and components that are readily available, but it incorporates these components into a unique architecture, that has never before existed in connection with electroluminescent display and lighting systems. The invention and architecture solve many problems that have hitherto existed with electroluminescent controllers, and use of the invention will convey many economic and logistical benefits to both manufacturers and end-users of electroluminescent display and lighting systems. This, in turn, will help lower the cost of these systems, will make them more profitable for manufacturers. It will also make these systems easier to use. The conjoined benefits that are derived from this invention will therefore cause the market for these systems to greatly expand.

DESCRIPTION OF THE INVENTION

In one embodiment of the present invention, the controller 10 comprises or consists of a motherboard, a power supply, and various inverters and waveform conditioners. The controller 10 may also include inbound/outbound communications facilities, motion sensing apparatus, ambient lighting detection, scanning/flatlining techniques, a floppy disk reader and internal storage devices.

In an embodiment of the invention in which the controller 10 uses flatlining techniques the controller 10 includes a photosensor or other means for determining the lamp brightness.

The photosensor is positioned to monitor the brightness of the electroluminescent lamp. Should the lamp brightness diminish to a certain extent or to a particular brightness the lamp voltage is increased to maintain brightness over time. The flatlining techniques can be implemented by providing electronic sensing circuits which monitor the electroluminescent cells of the lamp and make adjustments to compensate for variations in the contrast between the cells, while maintaining a fixed contrast between the lamp luminance and the ambient lighting. In this embodiment, separate feedback loops monitor the ambient lighting, the cell luminance, and the frequency of the excitation voltage and make appropriate adjustments to an adjustable luminance reference. The adjustments occur while a microprocessor sequences through an assortment of electroluminescent cells of various sizes. In another embodiment, instead of having a feedback loop to monitor the lamp luminance as it decreases due to aging, the circuit which drives the EL lamp includes a timer and a microprocessor. The timer measures the elapsed time during which the EL display has been operating. The microprocessor adjusts the drive signal to the EL display to compensate its brightness to be independent of its age, based on the elapsed time measured by the timer and an empirically determined aging parameter. This process for maintaining a necessary lamp brightness is described in greater detail in the commonly owned U.S. application Ser. No. 09/497,607 filed on Mar. 2, 2000, which application is incorporated by reference.

The purpose of the motherboard is to accept a series of instructions and to transmit these instructions to the display element 20 throughout the life of the particular application.

The inverters and waveform conditioners are regulated by the motherboard to produce the electrical characteristics specifically required by the display.

Figure 1A:
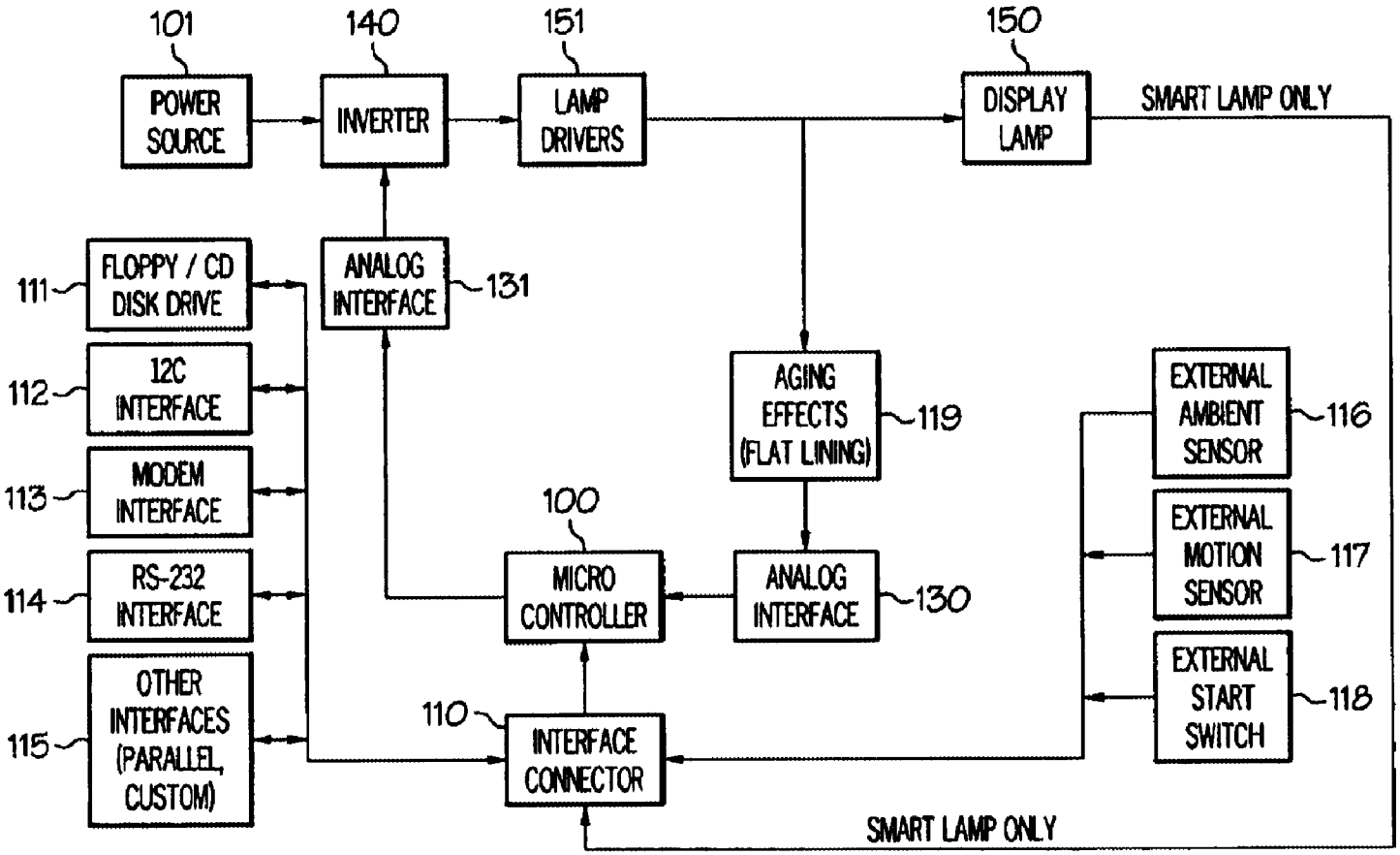
FIG. 1A is a control system block diagram of an embodiment of the present invention.

An embodiment of a system for controlling an electroluminescent lamp is illustrated in FIG. 1A. interface connector 110. The data is transmitted by a plurality of interfaces and sensors. For example, in the embodiment illustrated in FIG. 1, potential interfaces include floppy disk/CD drive 111, 12C interface 112, modem interface 113, RS-232 interface 114 and other interfaces 115. Floppy disk or CD-ROM drive 111 may be used as an alternate means to initially program the system, to reprogram the system or to load data into the system. Data from these interfaces is transmitted to interface controller 110 and to microcontroller 100. In addition, external ambient sensor 116, external motion sensor 117 and external start switch 118 transmit information to interface controller 110 and thus to microcontroller 100. Motion sensor 117 may be used to help determine how the system should react when an animate object approaches it. Ambient sensor 116 may be used to regulate the system, the power consumed or other features of the display. Aging effects compensation and flatlining apparatus 119 is also connected with microcontroller 100 through analog interface 130. Scanning and/or flatlining techniques may be used to enhance the life of the system or display, or to otherwise improve the system's performance. In this embodiment, a further analog interface 131 allows microcontroller 100 to communicate with inverter 140 and hence lamp drivers 151. Lamp drivers 151 control display lamp 150.

Figure 1B:
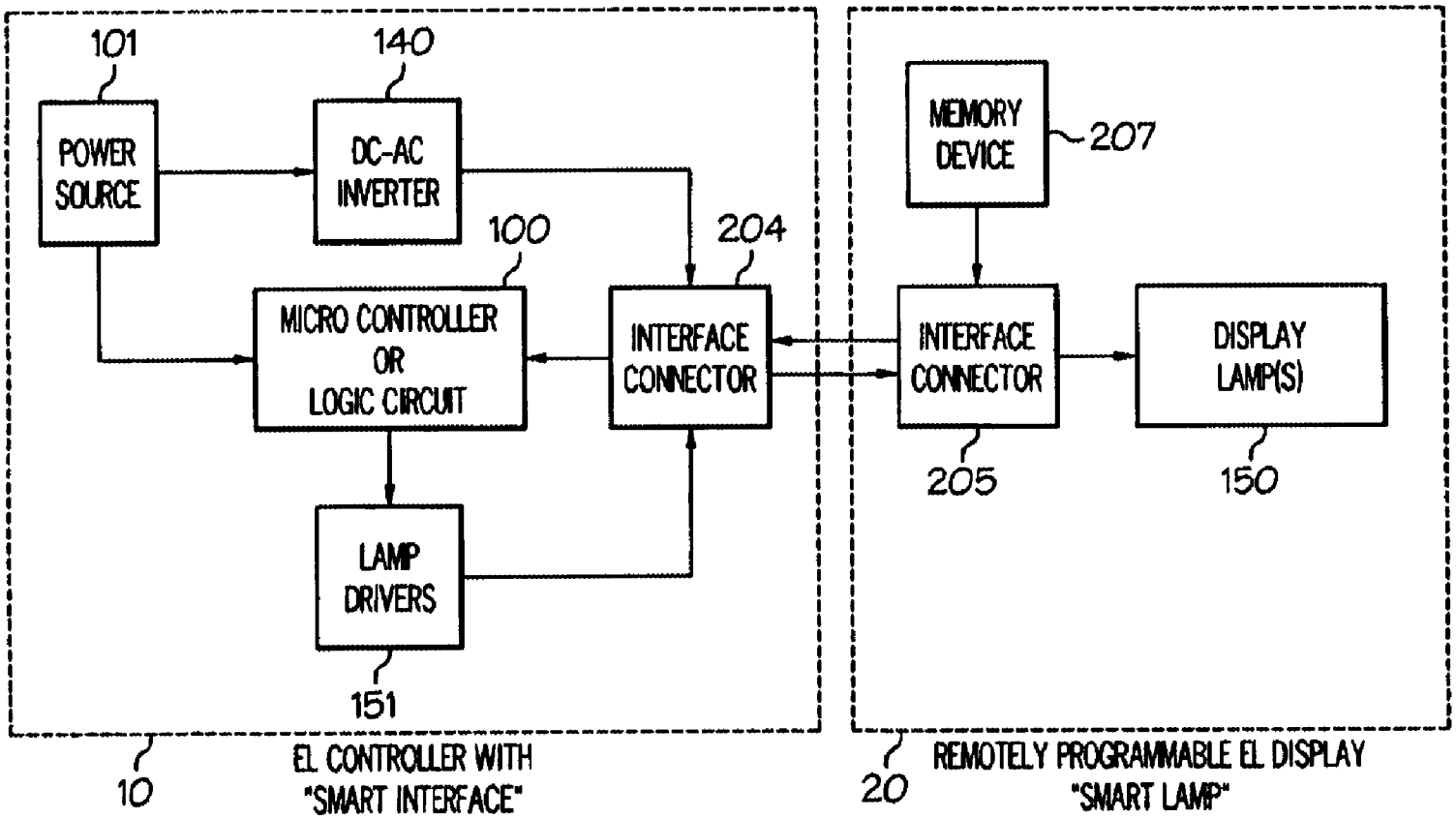
FIG. 1B is a control system block diagram of an embodiment of the present invention.

In the present invention, as shown in FIGS. 1A and 1B, display lamp assembly 150 provides input to microcontroller 100 through interface connector 110.

Power source 101 supplies power for the elements of the lamp assembly. The power supply can comprise 110–240V AC or batteries or other appropriate power supplies. The power supply conveys an electrical current for the system.

Figure 2A:
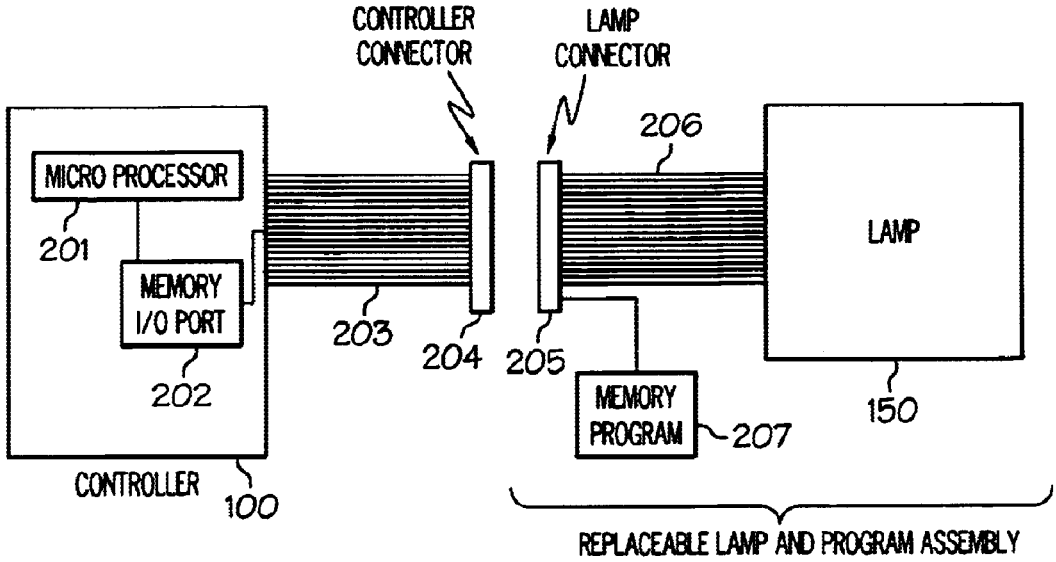
FIG. 2 illustrates one embodiment of the invention in which the microcomputer is programmed or receives information through use of an external memory device.
Figure 2B:
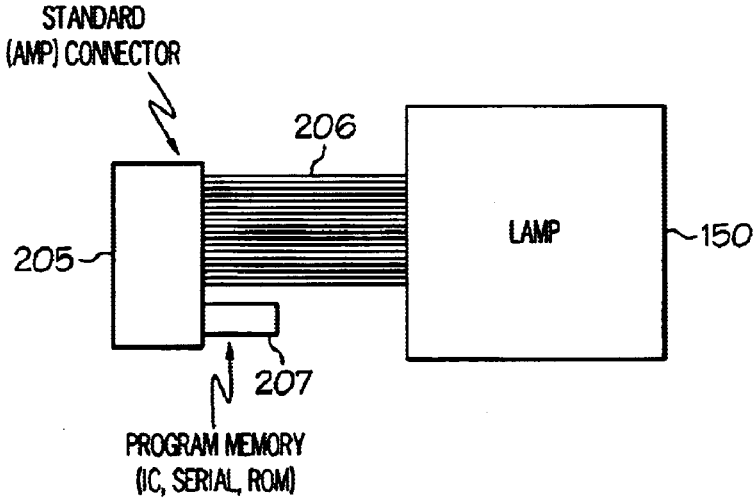

FIG. 2 illustrates the connection between microcontroller 100 and electroluminescent lamp 150. Microcontroller 100 comprises microcomputer or motherboard 201 and memory input/output port 202. Microcontroller 100 is connected with controller connector 204 by cable 203. Controller connector 204 and lamp connector 205 are in communication. Lamp connector 205 is connected with display lamp 150 by cable 206. Further, in this embodiment program memory 207 is connected with lamp connector 205.

Program memory 207 provides programming or data to microcomputer 201, which in turn controls lamp 150.

Internal storage devices may be used to contain programs and/or data that are useful to the motherboard and/or the display element 20. There are numerous proposed ways to communicate and/or interact with the motherboard of the present invention. One method involves including an external memory device, such as program memory 207 or a flash memory card, in the display element 20. When the motherboard senses a new device, or discovers that an existing device has been removed, it will attempt to establish a connection with the display element 20 in an effort to load and/or initiate a new set of programming instructions. There are many existing devices that can be carried on board the display element 20 in the manner shown by FIG. 2.

Figure 3:
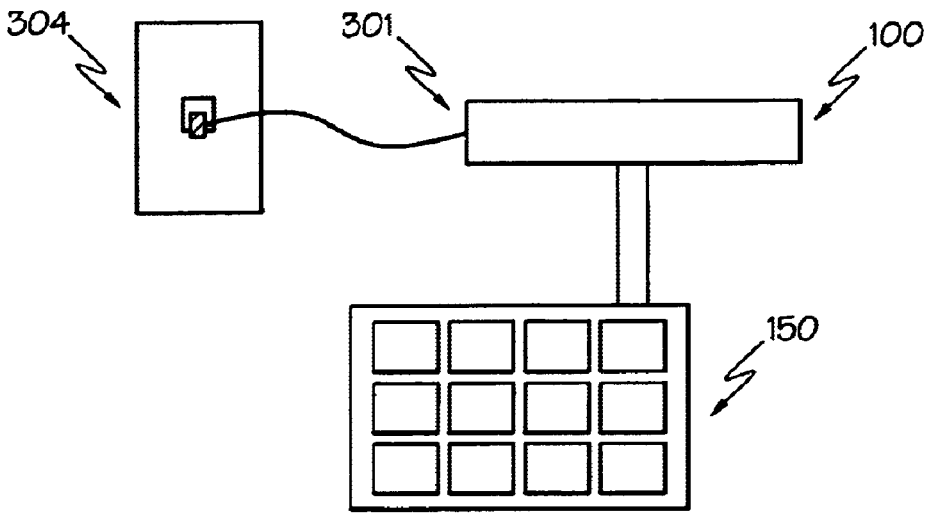
FIG. 3 illustrates a further embodiment of the invention in which a remote network connection way allows communication and/or interaction with the microcontroller.

FIG. 3 illustrates another way to allow communication and/or interaction with microcontroller 100. In this method a remote network connection is used. Phone jack 304 and communications adapter or modem 301 may be fitted to microcontroller 100 and telephone dialing and answering facilities. Microcontroller 100 can therefore be accessed remotely by phone, and receive programming and/or data by download. Alternatively, microcontroller 100 can itself sense the need for a new program and/or data, and can initiate the connection to either upload information that it contains, or to request downloaded programs and/or data. Microcontroller 100 is connected with lamp 150 by cable 302.

Figure 4:
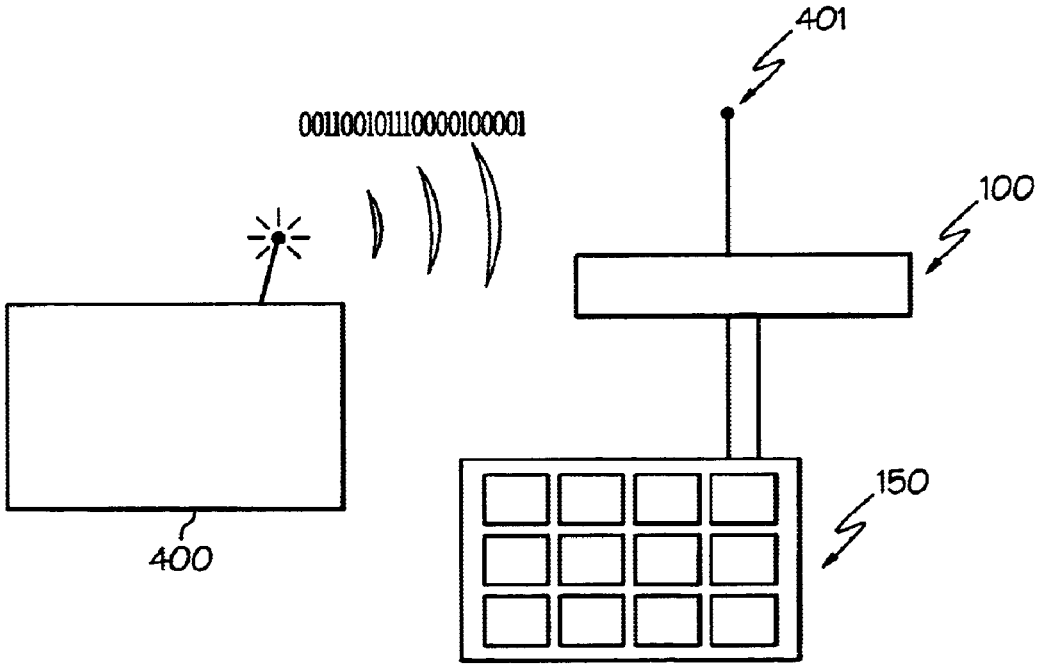
FIG. 4 depicts remote, wireless programming of a microcontroller in an embodiment of the invention.

FIG. 4 illustrates remote, wireless programming of microcontroller 100. In this embodiment transmitter 400 programs the controller. Transmitter 400 can be remote to the controller and wireless. Transmitter 400 may be carried on-board the electroluminescent system, or may be positioned in another accessible area, or may be transported by hand. In this embodiment of the invention microcontroller 100 includes receiver 401 through which microcontroller 100 receives the programming information transmitted by transmitter 400.

Figure 5:
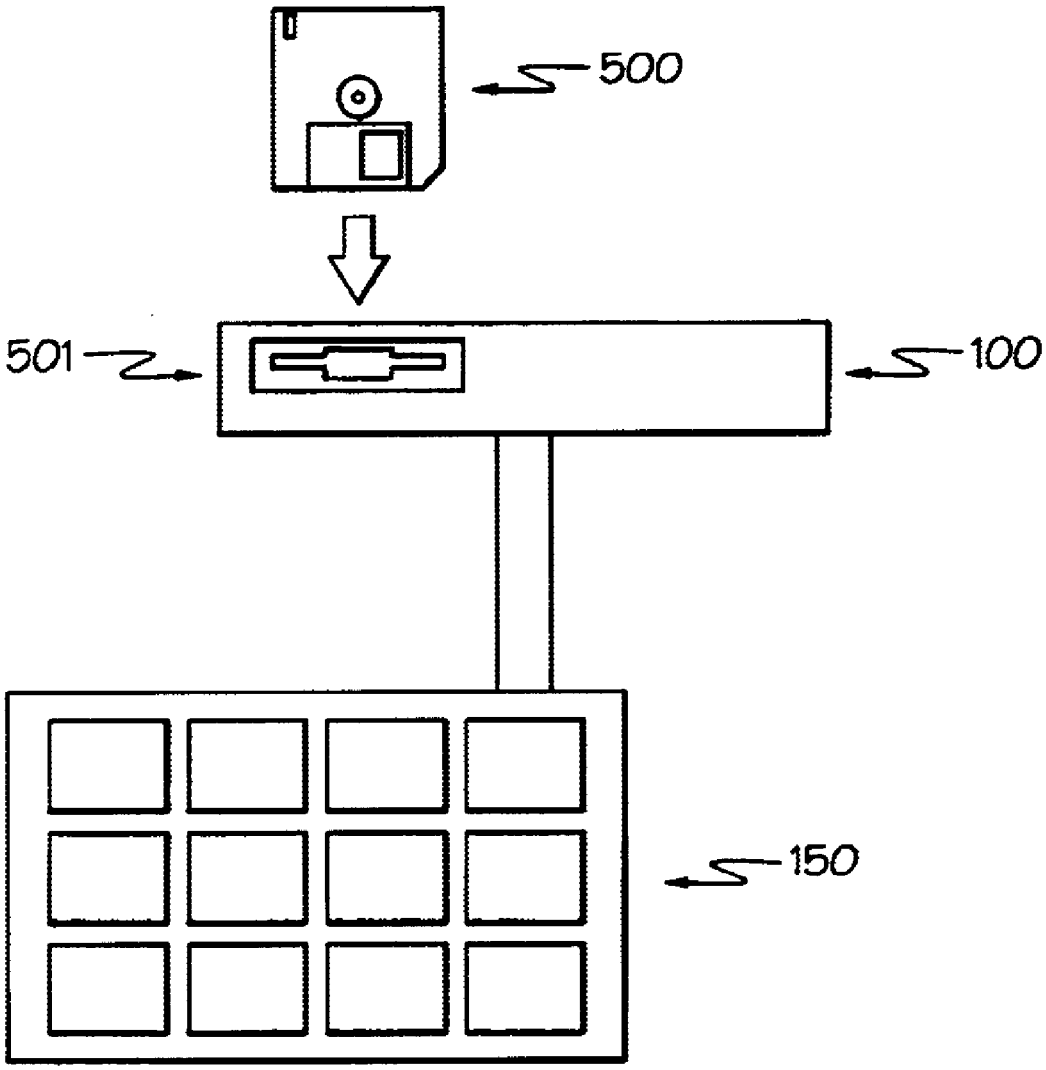
FIG. 5 depicts a further embodiment of the invention in which the interface with the microcontroller comprises a floppy disk or other external storage media.

FIG. 5 depicts a further embodiment of the invention in which the interface with microcontroller 100 comprises floppy disk 500. Floppy disk 500 is inserted into floppy disk drive 501. Alternately the interface can comprise a CD/ROM or other external storage media that can be inserted into a drive on the controller in order to program the motherboard, download and/or upload data.

Figure 6:
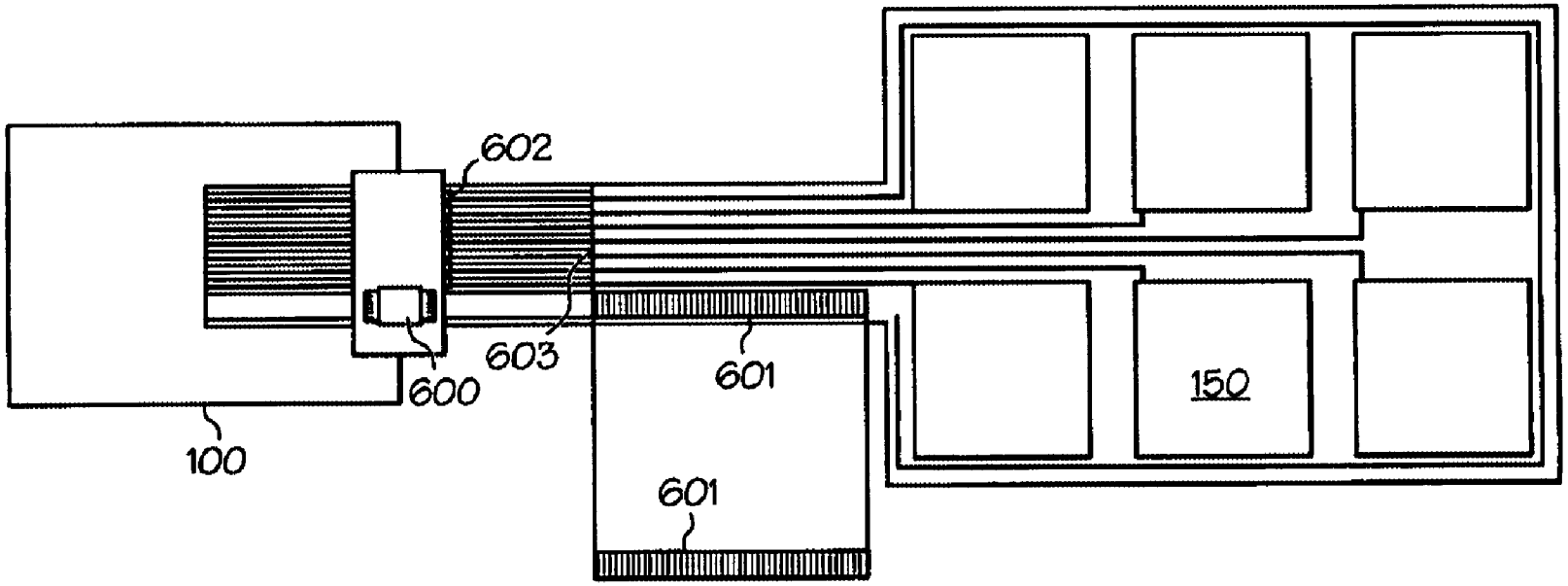
FIG. 6 illustrates yet another embodiment of the present invention in which the microcontroller receives information through detecting the driving instructions from the lamp display itself.

FIG. 6 illustrates an embodiment of the present invention in which display lamp 150 contains magnetic or optical encoding and/or other data storage schemes such that microcontroller 100 can download programs, instructions and/or data directly from display lamp 150. In this embodiment display lamp 150 has, in effect, been transformed into a floppy disk and therefore, serves a dual purpose. Display lamp 150 includes printed circuitry 603 and reader strip 601 that can be inserted into reader 600 that is associated with microcontroller 100. Pin connector 602 allows the connection between display lamp circuitry 603 and reader 600.

The display element 20 itself can contain magnetic, electrical or optical encoding and/or other data storage schemes.

The controller may have a motherboard, one or more inverters and one or more waveform conditioners. The controller also may have a means for receiving information. The information comprises programming or sequencing instructions for the electroluminescent display or lighting system. The controller may also have a means for detection of lamp brightness and means for varying the lamp voltage to produce a desired lamp brightness.

We claim:

1. An electroluminescent display system comprising:

an electroluminescent lamp display unit having plurality of display lamps and a memory contained within the electroluminescent lamp display unit, said memory storing lamp control data, said lamp control data including images to be displayed on the plurality of display lamps, and a controller unit for controlling in response to the lamp control data the illumination of said plurality of display lamps, said controller unit selectively connected to said electroluminescent lamp display unit, said controller unit including a receiver for receiving said lamp control data from said memory.

2. The electroluminescent display system described in claim 1, wherein the memory comprises a reader strip which is magnetically, electrically, mechanically or optically encoded and wherein the means for downloading data comprise a reader.

3. The electroluminescent display system described in claim 1, wherein the electroluminescent lamp display unit further includes printed circuitry and a reader strip, wherein the controller unit further includes a reader and pin connectors and wherein the printed circuitry is adapted to be attached with the reader using the pin connectors.

4. An electroluminescent system comprising:

a controller unit; and a display unit selectively connected to the controller unit, the display unit including:

a plurality of display lamps;

a memory device contained within the display unit that stores lamp control data, the lamp control data containing images used by the controller unit to display said images on the plurality of display lamps;

a display interface connector that selectively connects the display unit to the controller unit; and data transmission means fox transmitting lamp control data from the memory device to the controller unit.

5. The electroluminescent system of claim 4, wherein the controller unit includes at least one controller interface connector connectable to the display interface connector, whereby the lamp control data can be uploaded to the controller unit from the memory.

6. The electroluminescent display of claim 5, wherein the controller unit includes:

a lamp driver for controlling operation of the plurality of display lamps; and means for operating the driver in accordance with the lamp control data.

7. The electroluminescent display of claim 6, wherein the controller interface connector and the display interface connector connect the lamp driver to the display lamp.

8. An electroluminescent display system comprising:

an electroluminescent lamp display unit having a plurality of display lamps and at least one means for data storage, said means for data storage storing lamp control data, the lamp control data consisting of an image to be displayed on the plurality of display lamps, and a controller unit selectively connected to said electroluminescent lamp display unit, said controller unit including means for receiving said lamp control data from said means for data storage when said controller unit is connected to said electroluminescent lamp display unit.

9. The electroluminescent display system described in claim 8, wherein the means for data storage comprise a reader strip which is magnetically, electrically, mechanically or optically encoded and wherein the means for downloading data comprise a reader.

10. The electroluminescent display system described in claim 8, wherein the electroluminescent lamp display unit further includes printed circuitry and a reader strip, wherein the controller unit further includes a reader and pin connectors and wherein the printed circuitry is adapted to be attached with the reader using the pin connectors.

11. A controller unit for controlling the images displayed on an electroluminescent display unit in response to lamp control data, the lamp control data including images to be displayed on the electroluminescent display unit, comprising:

a connector for connecting the controller unit to the electroluminescent display unit; and a receiver contained within the controller unit for receiving lamp control data from the electroluminescent display unit.

12. An electroluminescent lamp display unit, the illumination of the electroluminescent lamp display unit, controlled by a controller unit, the controller unit being remote from the electroluminescent display unit, comprising:

a plurality of display lamps;

a memory contained within the electroluminescent lamp display unit for storing lamp control data, the lamp control data including images to be displayed on the plurality of display lamps; and a transmitter for transmitting the lamp control data to the controller unit from the memory.

* * * * *

UNITED STATES PATENT AND TRADEMARK OFFICE

CERTIFICATE OF CORRECTION

PATENT NO. : 6,771,256 B1
DATED : August 3, 2004
INVENTOR(S) : Abraham et al.

It is certified that error appears in the above-identified patent and that said Letters Patent is hereby corrected as shown below:

Column 5,
Line 41, “fox” should be -- for --

Signed and Sealed this

Second Day of November, 2004

JON W. DUDAS
*Director of the United States Patent and Trademark Office*